US006168119B1

(12) United States Patent
Meier et al.

(10) Patent No.: US 6,168,119 B1
(45) Date of Patent: Jan. 2, 2001

(54) DEVICE FOR AUTOMATICALLY LOCATING A RAILWAY VEHICLE

(75) Inventors: Michael Meier, Braunschweig; Axel Paulsburg, Cremlingen; Hans-Joachim Vornholz, Braunschweig, all of (DE)

(73) Assignee: Siemens AG, Munich (DE)

( * ) Notice: Under 35 U.S.C. 154(b), the term of this patent shall be extended for 0 days.

(21) Appl. No.: 09/214,197

(22) PCT Filed: Jul. 1, 1997

(86) PCT No.: PCT/DE97/01411

§ 371 Date: Sep. 20, 1999

§ 102(e) Date: Sep. 20, 1999

(87) PCT Pub. No.: WO98/00328

PCT Pub. Date: Jan. 8, 1998

(30) Foreign Application Priority Data

Jul. 1, 1996 (DE) ..... 196 27 343

(51) Int. Cl.[7] ..... B61L 15/00
(52) U.S. Cl. ..... 246/122 R; 246/194
(58) Field of Search ..... 246/63 R, 63 C, 246/122 R, 124, 178, 194, 167 R, 182 B; 340/968

(56) References Cited

U.S. PATENT DOCUMENTS 3,877,666 * 4/1975 Itakura et al. ..... 246/122 R
3,906,436 * 9/1975 Kurauchi et al. ..... 246/122 R
3,958,783 * 5/1976 Rhoton ..... 246/167 R
3,974,992 * 8/1976 Matty ..... 246/182 B
4,491,967 * 1/1985 Kobayashi et al. ..... 246/122 R
5,364,047 * 11/1994 Petit et al. ..... 246/122 R

FOREIGN PATENT DOCUMENTS 11 76 698 3/1962 (DE) .
19 08 400 10/1969 (DE) .
32 05 314 9/1983 (DE) .
0 098 896 1/1984 (EP) .
0 654 390 5/1995 (EP) .
2 562 018 10/1985 (FR) .

* cited by examiner

*Primary Examiner*—Mark T. Le
(74) *Attorney, Agent, or Firm*—Kenyon & Kenyon

(57) ABSTRACT

On vehicles on which only a single receiving antenna is provided or where a plurality of receiving antennas which are arranged side by side and are coupled to the forward and return conductors of a line conductor are provided, the phase angle of the received voltage is retained when the voltage drops below a given received level. If the level of the received voltage rises again, the prevailing phase angle of the received voltage can be compared with that of the retained received voltage. If the received voltages to be compared are found to be in phase opposition, it is deduced that a line conductor intersection point has been passed; if they are in phase, transient transmission interference is inferred. The phase angle of the comparative voltage is preferably retained by a flywheel oscillator, with the time offset between the prevailing received voltage and the comparative voltage preferably being determined by weighting the peak values of the two voltages.

8 Claims, 2 Drawing Sheets

DEVICE FOR AUTOMATICALLY LOCATING A RAILWAY VEHICLE

FIELD OF THE INVENTION

The present invention relates to a device for self-location of a track-guided vehicle.

BACKGROUND INFORMATION

The present invention concerns a device according to the definition of the species of Patent German Patent No. 11 76 698, describes a device for self-location of a traction vehicle in conjunction with a train protection system with linear signal transmission between train and track. This traction vehicle is inductively coupled via coupler coils to a line conductor installed in the track; information relevant for control of the vehicle is supplied to the vehicle from a remote control station via the line conductor. The coupler coils are arranged at a 90° angle to one another and at a 45° angle to the line conductor loop. This coil arrangement makes it possible to send and receive frequency-modulated messages to and from a central station including when passing intersection points. Furthermore, this coil arrangement makes it easy to determine exactly when the vehicle with its antennas passed a line conductor intersection point. When leaving one line conductor section and entering the following line conductor section, the phase angle of the received voltages of the two coupler coils changes by 180°, with this phase shift being different for the two antennas, depending on location. Although the antenna pointed in the direction of travel is already coupled to the line conductor of the following section and receives signals from there with a 180° phase rotation in comparison with the signals received previously, the received voltage that can be picked up at the output of the antenna oriented in the direction opposite the direction of travel still has the original phase angle. The two phase angles can thus be compared with one another; it is deduced from the transiently simultaneous presence of received voltages in phase opposition that an intersection point has been passed. However, not only is the phase angle of the two received voltages evaluated to detect a line conductor intersection point, but also its amplitude is used, i.e., the amplitudes of two received voltages must have a certain minimum level for an intersection point to be detected. Transient transmission interference that cannot be interpreted as driving past an intersection point is characterized by the absence of such a minimum level.

In addition to transmission systems with receiving antennas in a crossed or offset arrangement on the vehicle, there are those with only a single antenna, as described in German Patent Application No. 19 08 400, or with two coupled receiving antennas arranged side by side on the forward and return conductors of a line conductor. With the help of these receiving antennas, it has so far been impossible to detect intersection points by phase discrimination. Although here again, the phase angle of the received voltages changes in passing a line conductor intersection point, the received voltages undergo a reversal of polarity at the same time. Thus, no reference phase is available to evaluate this phase shift, so that only the drop in level could be used in the past to detect an intersection point with such antenna arrangements.

SUMMARY OF THE INVENTION

The object of the present invention is to improve upon the existing devices for self-location of a track guided vehicle so that unambiguous detection of line conductor intersection points is possible even for vehicles with a single antenna or side-by-side receiving antennas coupled to the forward and return conductors of a line conductor by evaluating the phase angle of the received voltage. With a device according to the present invention, a drop in level caused by a line conductor intersection point can be differentiated unambiguously from a drop in level caused by transmission interference, loose contacts and the like.

As a consequence of the vehicle device retaining the instantaneously prevailing phase angle for a certain period of time when there is a drop in level, it is possible once the received voltage rises again to compare the phase angle of the received voltage prevailing then with the reference phase angle thus retained, to arrive at a decision regarding whether the drop in level was caused by passing a line conductor intersection point or by interference.

DETAILED DESCRIPTION

Figure 1:
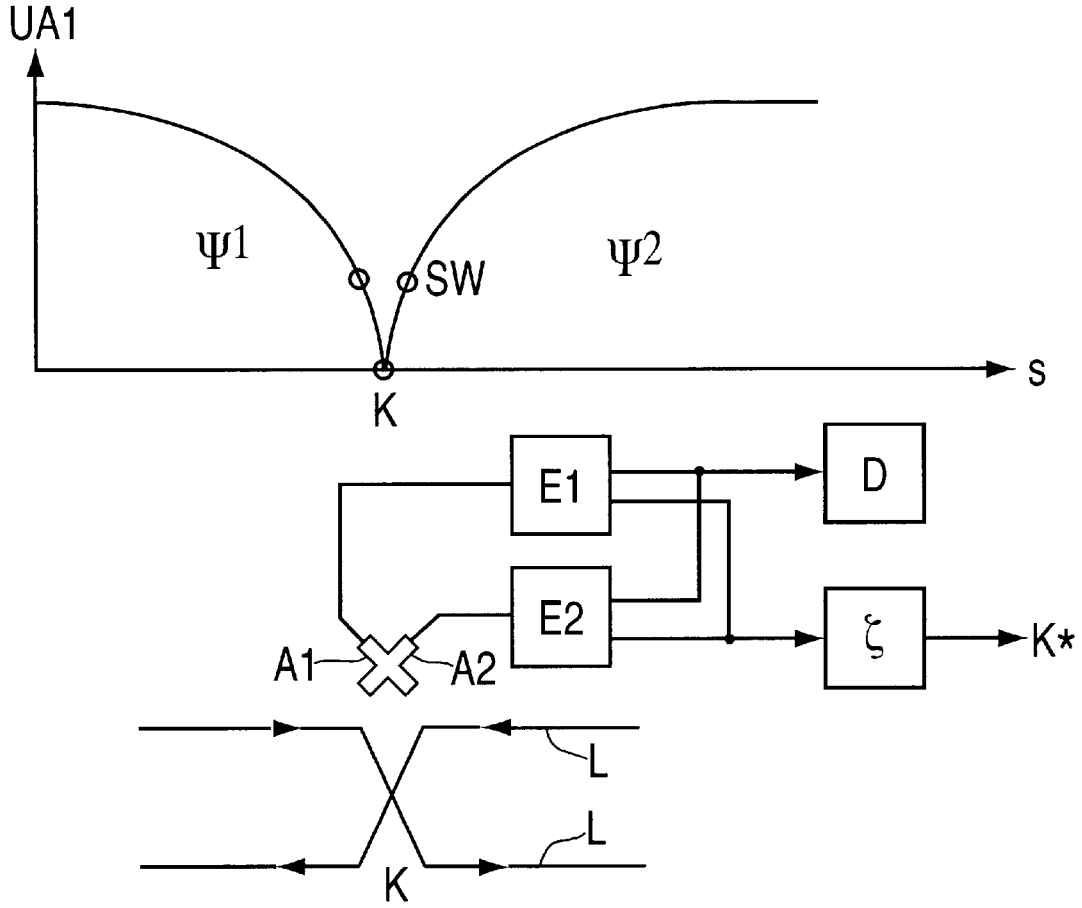
FIG. 1 PRIOR ART
FIG. 1 illustrates detection of line conductor intersection points according to conventional devices.

FIG. 1 illustrates a schematic diagram of a line conductor L which is laid between rails (not shown) of a track and through which a signal current flows in the direction of the arrow. This signal current creates magnetic fields around the line conductor, these magnetic fields are picked up by crossed receiving antennas A1, A2 of a vehicle traveling on the track. At an intersection point K, which the vehicle is supposed to detect in passing, the geometric arrangement of the forward and return conductors of the line conductor in the track changes markedly. As indicated by the diagram of received voltage UA1 of one of the vehicle's receiving antennas over rail section S, the received voltage drops as the vehicle's antenna approaches the intersection point, and then rises back to the same level. During this change in voltage level, the phase angle of the received voltage changes by 180° because signal current flows in different directions through adjacent sections of line conductor segments arranged below the antenna. The two receiving antennas on the line conductor transiently receive signals in phase opposition in passing a line conductor intersection point because of the different orientations of the two receiving antennas. These out-of-phase signals result in out-of-phase received voltages being made available at the outputs of downstream receivers E1, E2. These received voltages for detection of intersection points are evaluated in a phase comparator device $\phi$. At the same time, a discriminator D evaluates the amplitudes of the two received voltages. If the received voltages are above a predetermined lower threshold value SW and if phase comparator device $\phi$ detects the presence of out-of-phase received voltages at this time, it causes an identifying signal K* to be output for detecting a line conductor intersection point K just being passed by the vehicle antennas.

Figure 2:
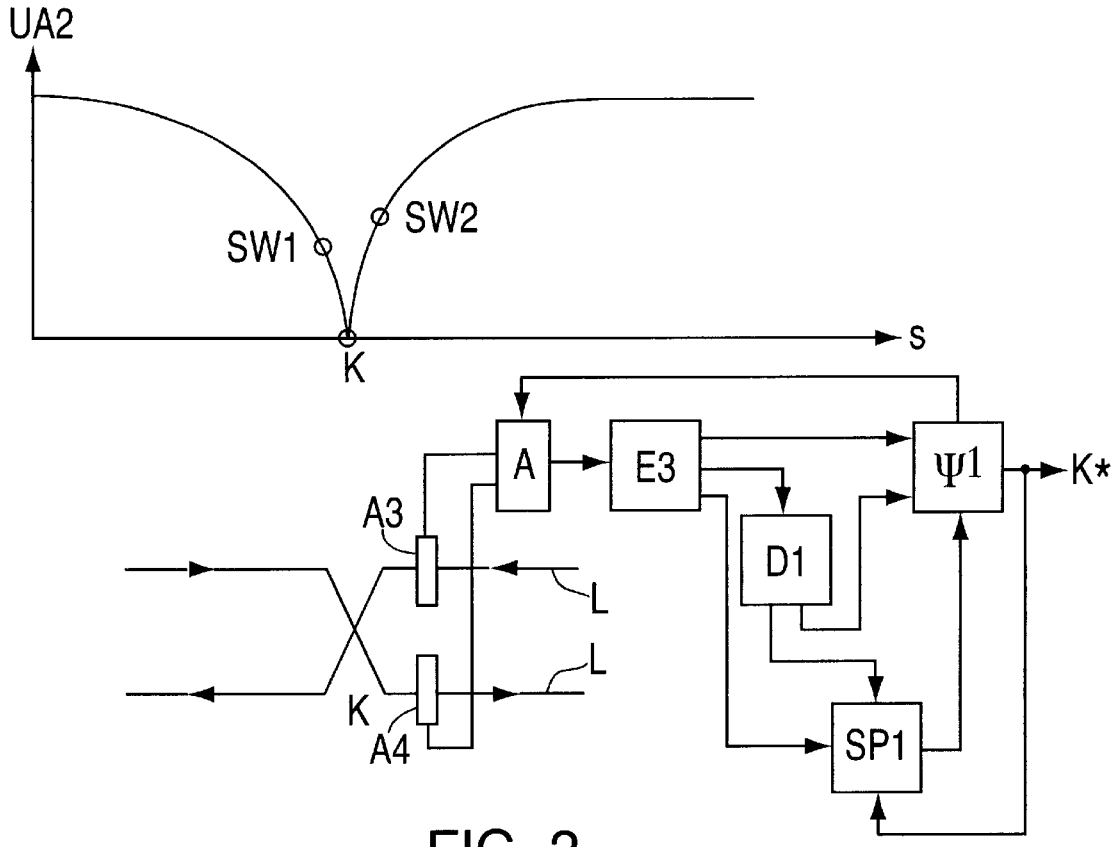
FIG. 2 illustrates detection of line conductor points according to an exemplary embodiment of the present invention.

It is assumed in FIG. 2 that the vehicle device has two receiving antennas A3 and A4 arranged side by side and coupled to the forward and return conductors of line conductor loop L. The received voltages picked up by these antennas are added up in correct phase relation in an adder A in a known manner and switched to a receiver E3. Received voltage UA3 of the receiving antenna drops when passing an intersection point and then increases again. The vehicle device retains the phase angle of received voltage UA3 or simulates it if it is below a predetermined lower threshold value SW1 to determine, once the receive voltage rises again, whether the detected drop in amplitude is due to transmission interference or due to passing an intersection point. If the amplitude of the received voltage later exceeds a second threshold value SW2, a discriminator D1 causes a phase comparator device $\phi 1$ to be activated to compare the phase angles of prevailing received voltage UA3 with the retained phase angle of the comparative voltage determined previously. If the two voltages are in phase opposition, this proves that the voltage drop was caused by passing over a line conductor intersection point.

The two threshold values at which the comparative phase is retained and the comparison procedure is carried out may be the same. In the exemplary embodiment, however, threshold value SW2 is above threshold value SW1. This ensures that the comparison procedure will take place in fact only when the received voltage has risen again.

In the embodiment shown here, discriminator D1 detects when the received voltage is below predetermined first threshold value SW1 and also when it exceeds predetermined second threshold value SW2. If the received voltage is below predetermined lower threshold value SW1, discriminator D1 causes the phase angle measured at receiver E3 to be retained in a memory SP1. If the received voltage exceeds the predetermined second threshold value SW2, discriminator D1 causes the phase value stored in memory SP1 to be compared with the phase angle of the received voltage, which may be picked up from receiver E3 in a phase evaluation device $\phi 1$. Assuming that the prevailing received voltage exceeds predetermined upper threshold value SW2, an identifying signal K* for the intersection point is outputted if the prevailing received voltage and the stored comparative voltage are in phase opposition, the phase value stored in memory SP1 is reset. Thus, the device is ready to respond to the next drop in received voltages in the same way as described above in detail.

Memory SP1 must supply the phase angle of the comparative voltage it detects to phase comparator device $\phi 1$ in a suitable form for a certain minimum period of time. However, since there is no reference phase, this is not done through a numerical quantity, but instead by generating signals in the memory or in an upstream structure where the phase relation of the signals to be compared can be detected for the subsequent phase comparison. For this reason, memory SP1 may be represented by a flywheel oscillator, which is synchronized to the frequency when the vehicle enters the line conductor area (received voltage rising above a given minimum level) and is synchronized to the prevailing phase angle of the line conductor current by time weighting of the amplitude maximums and minimums in conjunction with the zero crossings of the received voltage. This flywheel oscillator, which is constantly being synchronized, supplies at its output, at least for a predetermined period of time, signals that are representative of the phase angle of the received voltage determined previously even after the input voltage drops below threshold value SW1. By time comparison of the weighting of the peak values and zero crossings of the prevailing received voltage with the comparative voltage updated by the flywheel oscillator, it is possible to determine whether the two voltages to be compared are in phase or in phase opposition.

Instead of a flywheel oscillator, any other desired oscillator which may be adapted in frequency and phase angle to a voltage may also be used to supply the comparative signals for the phase comparison. Such oscillators are known as phase-locked-loop oscillators.

Preselection of the comparative phase angle by a flywheel oscillator or a structure with a similar effect for the comparison procedure is allowed only for a certain period of time, otherwise there is a risk that of the phase angle of the comparative signal may drift so far in comparison with the signal it is to represent that the phase comparator device might recognize the received voltages for comparison as being in phase opposition despite their being in phase. The deactivation of memory SP1 or its output signal after expiration of a maximum allowed period of time for passage of a line conductor intersection point may be triggered by a timing element, for example, which is activated by discriminator D1 when the memory is set.

It is not absolutely necessary to use two receiving antennas arranged side by side and coupled to the forward and return conductors of the line conductor to pick up line conductor information and detect line conductor intersection points. A single antenna may be used, but it may become more problematical to evaluate the content of the data transmitted because of the lower received level. In such a case the adder may be omitted. In addition to rail-mounted vehicles such as railway cars, streetcars, light rail and subway vehicles, MAGLEV vehicles and vehicles guided on a track by inductive conductors may also be understood in this context to be track-guided vehicles.

What is claimed is:

1. A device for self-location of a track-guided vehicle on a track, the track being subdivided into sections by crossed, externally powered line conductor loops, the device comprising:

at least one receiving antenna inductively coupled to at least one of forward conductors of the line conductor loops and return conductors of the line conductor loops, the at least one receiving antenna receiving a voltage;

at least one oscillator tunable to a frequency of at least one of a line conductor current of the line conductor loops or a multiple of the frequency, the at least one oscillator being synchronized to the received voltage at least with regard to phase on entering the line conductor loops, and being continuously corrected;

a detecting arrangement detecting when the received voltage drops below a first level, a phase angle of the received voltage being retained when the received voltage drops below the first level; and a processing arrangement comparing the phase angle of the received voltage to a phase angle of a prevailing voltage of the at least one oscillator, wherein when the phase angle of the received voltage is out of phase with respect to the phase angle of the prevailing voltage, the processing arrangement triggers a signal if the received voltage exceeds a second level, the signal identifying that a line conductor intersection point has been passed.

2. The device according to claim 1, wherein the second level exceeds the first level by a predetermined amount.

3. The device according to claim 1, wherein a resettable time limit is provided, the phase angle of the prevailing voltage being retained for the time limit, the time limit being a maximum period of time allowed for passing the line conductor intersection point.

4. The device according to claim 1, wherein the phase angle between the received voltage and the prevailing voltage is determined by time weighting of peak values and zero crossings of the received voltage and the prevailing voltage.

5. The device according to claim 1, further comprising:

antenna arrangements, each of the antenna arrangements including one of i) a single one of the at least one receiving antenna, and ii) a plurality of the at least one receiving antenna, the antenna arrangements being arranged side-by-side across the track, each of the antenna arrangements being coupled to the forward conductors of the line conductor loops and the return conductors of the line conductor loops.

6. The device according to claim 1, wherein the at least one oscillator is set at a basic frequency, the basic frequency being determined by a frequency of the line conductor current before the received signal has dropped below the first level, the basic frequency being determined if and as long as a received level of the received voltage exceeds a predetermined minimum value.

7. The device according to claim 1, wherein the at least one oscillator includes a flywheel oscillator.

8. The device according to claim 1, wherein the at least one oscillator includes a phase-locked-loop oscillator.

* * * * *